US005614152A

United States Patent [19]

Selby et al.

[11] Patent Number: 5,614,152

[45] Date of Patent: Mar. 25, 1997

[54] TEMPERATURE CONTROL CHIMNEY

[75] Inventors: Theodore W. Selby, Midland; William A. Atkins, Bay City, both of Mich.

[73] Assignee: Tannas Co., Midland, Mich.

[21] Appl. No.: 425,589

[22] Filed: Apr. 20, 1995

[51] Int. Cl.[6] ..... B01L 11/00

[52] U.S. Cl. ..... 422/99; 422/104

[58] Field of Search ..... 422/104, 102, 422/99, 300, 297, 302, 303; 454/43; 362/312–16

[56] References Cited

U.S. PATENT DOCUMENTS

| | | | |
|---|---|---|---|
| 648,242 | 4/1900 | Cronkhite | 422/300 |
| 791,862 | 6/1905 | Bauer | 422/300 |
| 950,876 | 3/1910 | Talbott | 422/300 |
| 1,763,461 | 6/1927 | Fowler | 422/104 |
| 3,776,127 | 12/1973 | Muse | 99/482 |
| 4,327,060 | 4/1982 | Nisii | 422/300 |
| 4,552,720 | 11/1985 | Baker, Sr. et al. | 422/300 |

*Primary Examiner*—Jill Warden
*Assistant Examiner*—Alexander Markoff
*Attorney, Agent, or Firm*—Christopher John Rudy

[57] ABSTRACT

Temperature control chimney has a hollow cylindrical housing, which is immersible in a liquid of a bath tub, having means for positioning in the tub, and top and bottom openings in the housing useful for permitting uniform liquid current flow. Preferably, it has means for holding at least one sample within the housing. The invention can be used to improve sample preparation, for an illustrative example, in sensitive viscosity testing.

8 Claims, 2 Drawing Sheets

Fig. 1
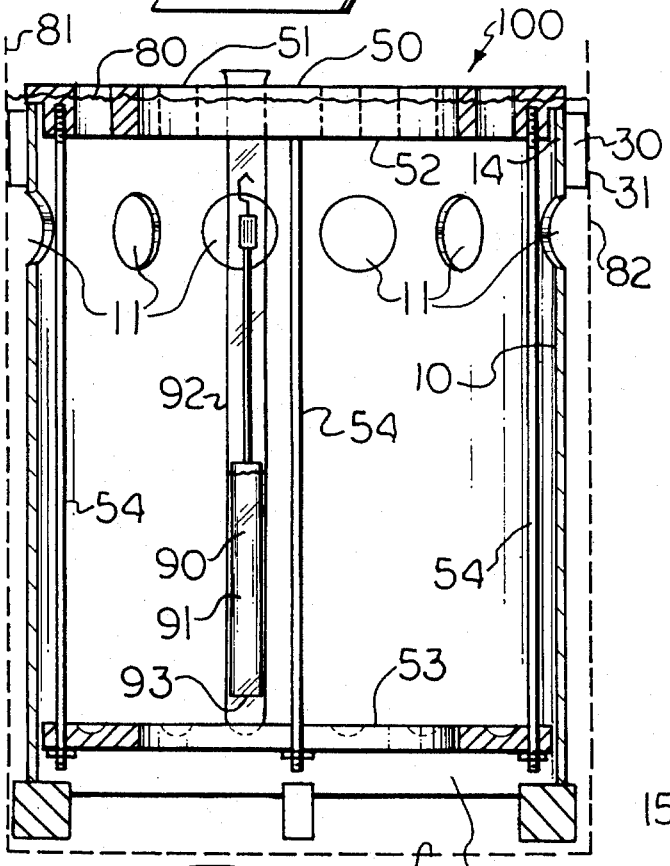
Fig. 2
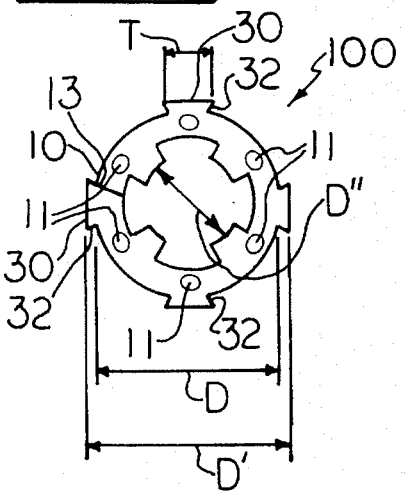
Fig. 3
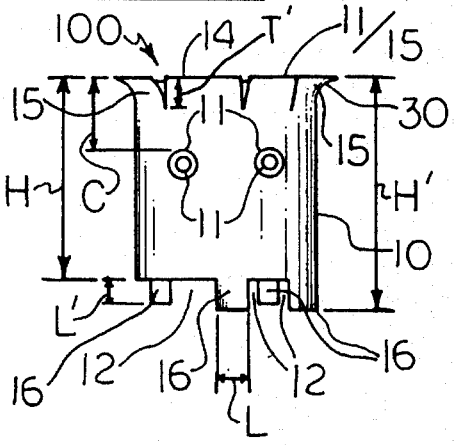
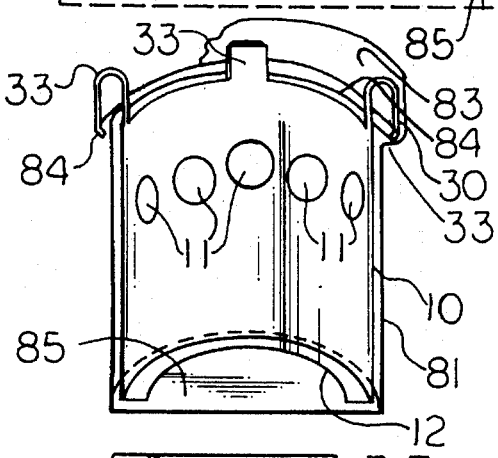
Fig. 4

TEMPERATURE CONTROL CHIMNEY

FIELD

This invention concerns temperature control.

BACKGROUND

In tests and other activities, constant temperature is necessary to obtain proper accuracy for such work. What is more, uniform sample pretreating in a heating bath is often desirable to obtain the most repeatable results, as the properties of the materials which are to be tested can be affected by differing rates of heating. For example, in viscometry, the slightest difference may make for inaccurate viscosity data. However, higher and higher accuracy in data is being demanded in the viscosity testing art. And yet, in known heat treating baths, especially including water baths, the heating of the samples can be undesirably nonuniform, at time even when using mechanical stirrers.

what is lacking and needed in the art are ways or means to provide for more uniform heating and temperature control with such baths. Desirably, any solution to such problems should be readily applied or made, and simple in use.

SUMMARY

The present invention provides a temperature control chimney comprising a hollow cylindrical housing, immersible in a liquid of a bath tub, having means for positioning in the tub, and top and bottom openings in the housing useful for permitting uniform liquid current flow, preferably with means for holding at least one sample within the housing.

The invention is useful in heat control in heat baths.

Significantly, the invention ameliorates or solves the aforementioned problems in the art by generating even convective flow of the bath liquid. Mechanical stirrers can be avoided. Thus, for an example, viscosity testing can be carried out with even greater accuracy and confidence. It is simple in construction and readily manufacturable, and very simple to set up and use.

Numerous further advantages attend the invention.

DRAWINGS

The drawings form part of the specification hereof. In the drawings, in which like numerals refer to like features, the following is briefly noted:

FIG. 1 is a side cut away view of a temperature control chimney of the invention.

FIG. 2 is a top view of another embodiment of a temperature control chimney housing of the invention.

FIG. 3 is a top view of the chimney housing of FIG. 2.

FIG. 4 is a perspective cut away view of another embodiment of a temperature control chimney hereof.

ILLUSTRATIVE DETAIL

Figure 5:
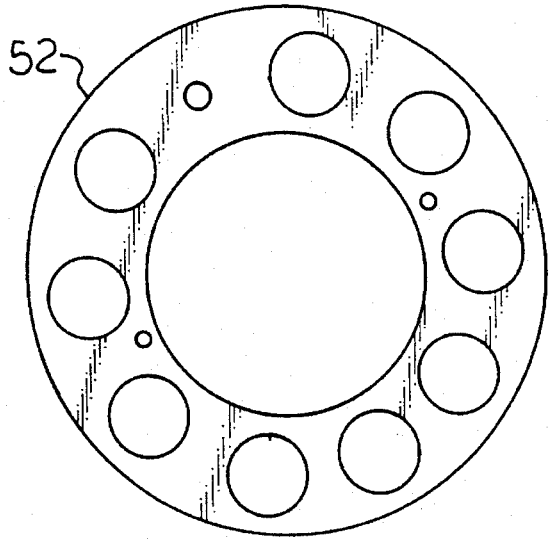
FIG. 5 is a top view of a top stator rack part.
Figure 7:
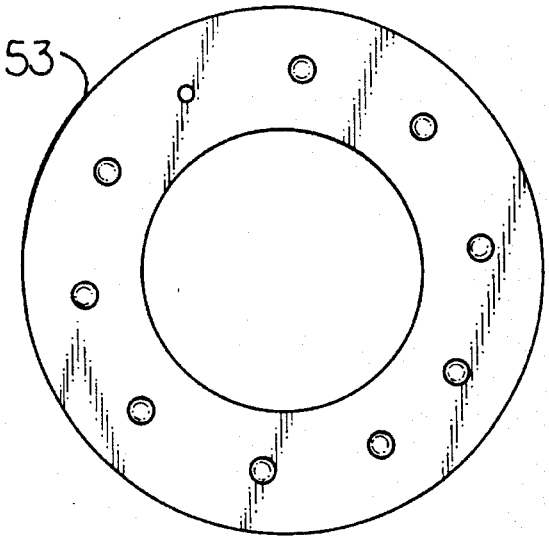
FIG. 7 is a top view of a bottom stator rack part.
Figure 6:
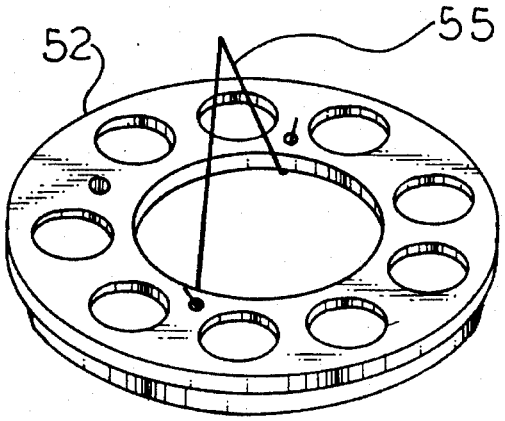
FIG. 6 is a top perspective view of the part of FIG. 5.
Figure 8:
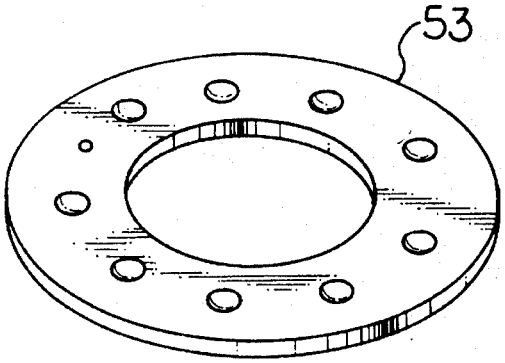
FIG. 8 is a top perspective view of the part of FIG. 7.

The invention can be better understood with reference to particular, but not necessarily limiting, embodiments:

Thus, in further reference to the drawings, in general, temperature control chimney 100 has hollow cylindrical housing 10, which is immersible in liquid 80 of bath tub 81. The chimney 100 has means for positioning 30 in the tub, and top opening(s) 11 and bottom opening(s) 12 in the housing 10 which are useful for permitting uniform liquid current flow. Advantageously, the chimney 100 has means for holding 50 at least one sample 90 within the housing 10.

The temperature control chimney may be made of any suitable material such as of a suitable metal or plastic and so forth and the like. Its components may vary in materials and construction, and may be made through casting, molding, stamping, bending, drilling, threading, tapping, welding, brazing, soldering, gluing, friction fitting and so forth and the like as those skilled in the art appreciate.

For example, the chimney 100 may have housing 10 of plastic (FIG. 1) or metal (FIGS. 2, 3 & 4) with top openings 11 and bottom opening(s) 12. The means for positioning 30 can include top spacers 31 (FIG. 1) or simple bent top tabs 32 (FIGS. 2 & 3) which project outwardly so as to contact the bath tub 81 at side wall 82 and/or bent top tabs 33 (FIG. 4) which project upwardly a suitable distance, are bent outwardly so as to contact bath tub 81 at upper side wall 83 and rest on tub shoulder 84.

The chimney may be of any suitable size, and it is generally made to fit closely the bath tub boundaries into which it may go. For example, in reference to FIGS. 2 & 3, cylindrical housing 10, of about 3/32 inch (ca. 0.24 cm) thick stainless steel, has housing height H of about 6¾ inches (ca. 17.1 cm); overall height H' of about 7¾ inches (ca. 19.7 cm); cylinder diameter D of about 4⅜ inches (ca. 11.1 cm); contact diameter D' of about 4 9/16 inches (ca. 12.6 cm) and leg diameter D" of about 4 3/16 inches (ca. 11.6 cm). Weld 13 is present. Six top openings 11, each a circle of about 1 inch (ca. 2.54 cm) in diameter, are present a distance C of about 1½ inches (ca. 3.8 cm) between housing top rim 14 and the top of the circumference of each circle. Four top tabs 15, each with tab width T of about 1 inch and tab height T' of about 1 inch, are cut from the housing 10 and bent outwardly to provide the contact diameter D'. Four bottom legs 16, each with leg width L of about 1 inch and leg height of L' about 1 inch, are provided by cutting away surplus housing between the legs 16, and the legs 16 are bent inwardly to provide the leg diameter D". Thus, bottom openings 12 between the legs 16 are provided. The top circular openings 11 are opposed, being spaced apart at 0, 60, 120, 180, 240 and 300 radial degrees. The top tabs 15 are staggered with respect to the bottom legs 16, with top tabs 15 at 0, 90, 180 and 270 radial degrees, and bottom legs 16 at 45, 135, 225 and 315 radial degrees.

The chimney 100 may be embodied to rest on bath bottom 85 (FIGS. 1, 2 & 3) or be suspended from the bath bottom 85 (FIG. 4). Advantageously, the temperature control chimney rests on the bottom of the bath.

The chimney 100 may have means for holding 50 at least one sample 90 within the housing 10. The holding means 50 can be a sample rack 51 made up of a top stator rack part 52 and a bottom stator rack part 53 connected by spacing rods 54. The sample rack 51 may be embodied to rest on the housing top rim 14 through the top stator rack part 52. A rack handle 55 may be included so as to make it easy to manipulate the sample rack 51 into or out of the liquid 80, which may be hot water, of bath tub 81. A sample 90, which may be a test oil 91 may be in rotational viscometer stator 92 with suitable rotor 93, may be inserted into the means for holding 50 inside the chimney housing 10 and immersed in bath liquid 80. Preferably, heat to the bath 81 is applied near the center of the bath bottom 85.

The invention can be used to improve sample preparation for many applications, to include, for example, in sensitive viscosity testing. It provides for uniform heating of samples in a bath, which is so critical to providing the most accurate testing methodology, especially in viscometry.

CONCLUSION

The present invention is thus provided. Numerous modifications can be effected within its spirit, the literal claim scope of which is particularly pointed out as follows:

We claim:

1. A temperature control chimney comprising a hollow, generally cylindrical housing with a main part thereto apportioned into upper, middle and bottom portions; the housing being immersible in a liquid of a bath tub; the chimney having means for positioning useful for positioning the chimney in the tub, and having a plurality of top openings evenly distributed around the upper portion of the main part of the housing, the middle portion of the main part of the housing which is imperforate and a single circular bottom opening in the housing; the chimney being useful for permitting uniform liquid current flow of heated liquid when the housing is immersed in the liquid of the bath tub.

2. The chimney of claim 1, with means for holding at least one sample within the housing.

3. A temperature control chimney comprising a hollow, generally cylindrical housing with a main part thereto apportioned into upper, middle, and bottom portions; the housing being immersible in a liquid of a bath tub; the chimney having means for positioning useful for positioning the chimney in the tub, and having a plurality of top openings in the upper portion of the main part of the housing, the middle portion of the main part of the housing which is imperforate, and at least one bottom opening in the bottom portion of the main part of the housing; the chimney being useful for permitting uniform liquid current flow of heated liquid when the housing is immersed in the liquid of the bath tub, wherein the means for positioning include a plurality of top tabs bent outward from the upper third of the main part of the housing.

4. A temperature control chimney comprising a hollow, generally cylindrical housing with a main part thereto apportioned into upper, middle, and bottom portions; the housing being immersible in a liquid of a bath tub; the chimney having means for positioning useful for positioning the chimney in the tub, and having a plurality of top openings evenly distributed around the upper third portion of the main part of the housing, the middle portion of the main part of the housing which is imperforate, and a plurality of bottom openings evenly distributed around the bottom third portion of the main part of the housing; the chimney being useful for permitting uniform liquid current flow of heated liquid when the housing is immersed in the liquid of the bath tub; and which chimney has legs at the bottom portion of the main part of the housing, which can rest on a bath tub bottom, and which define the plurality of bottom openings.

5. The chimney of claim 4, with means for holding at least one sample within the housing.

6. A temperature control chimney comprising a hollow, generally cylindrical housing with a main part thereto apportioned into upper third, middle third, and bottom third portions; the housing being immersible in a liquid of a buth tab; the chimney having four top tabs bent outward from the upper third of the main part of the housing and positioned at 0, 90, 180 and 270 radial degrees; the chimney having six top openings inthe upper third portion of the main part of the housing positioned at 0, 60, 120, 180, 240 and 300 radial degrees, the middle portion of the main part of the housing which is imperforate, and four bottom legs in the bottom third portion of the main part of the housing having spaces therebetween, the spaces defining for bottom openings at 45, 135, 225 and 315 radial degrees; the chimney being useful for permiting uniform liquid current flow of heated liquid when the housing is immersed in the liquid of the bath tub.

7. The chimney of claim 6, which is made of metal.

8. The chimney of claim 7, which includes means for holding at least one sample within the housing.

* * * * *